US008061394B2

(12) United States Patent
Weh et al.

(10) Patent No.: US 8,061,394 B2
(45) Date of Patent: Nov. 22, 2011

(54) LOCKING DEVICE FOR A QUICK-ACTION CONNECTION COUPLING

(76) Inventors: Erwin Weh, Illertissen (DE); Wolfgang Weh, Illertissen (DE)

( * ) Notice: Subject to any disclaimer, the term of this patent is extended or adjusted under 35 U.S.C. 154(b) by 922 days.

(21) Appl. No.: 11/632,329

(22) PCT Filed: Jul. 14, 2005

(86) PCT No.: PCT/EP2005/007670
§ 371 (c)(1),
(2), (4) Date: Mar. 14, 2008

(87) PCT Pub. No.: WO2006/005618
PCT Pub. Date: Jan. 19, 2006

(65) Prior Publication Data

US 2008/0223486 A1 Sep. 18, 2008

(30) Foreign Application Priority Data

Jul. 14, 2004 (DE) ..... 20 2004 011 088 U

(51) Int. Cl.
*B67C 3/00* (2006.01)

(52) U.S. Cl. ..... 141/200; 141/206; 141/392

(58) Field of Classification Search ..... 141/98, 141/200, 206, 392; 251/90, 93, 101
See application file for complete search history.

(56) References Cited

U.S. PATENT DOCUMENTS

| | | | | | |
|---|---|---|---|---|---|
| 2,083,078 | A | * | 6/1937 | Mayo | 141/224 |
| 2,106,596 | A | * | 1/1938 | Duff, Jr. | 141/225 |
| 2,686,626 | A | * | 8/1954 | Slattery | 141/207 |
| 2,787,295 | A | * | 4/1957 | Houghton | 141/209 |
| 3,126,925 | A | * | 3/1964 | Boone | 141/209 |
| 3,273,609 | A | * | 9/1966 | Carder et al. | 141/206 |
| 3,520,338 | A | * | 7/1970 | Vest et al. | 141/128 |
| 3,540,496 | A | * | 11/1970 | Myers | 141/225 |
| 4,200,128 | A | * | 4/1980 | Pokrzywa | 141/392 |
| 4,593,729 | A | * | 6/1986 | Tamra | 141/218 |
| 5,067,533 | A | * | 11/1991 | Carder et al. | 141/392 |

FOREIGN PATENT DOCUMENTS

| | | |
|---|---|---|
| DE | 11 85 938 B | 1/1965 |
| DE | 12 26 904 B | 10/1966 |
| WO | WO 88/01601 A | 3/1988 |

* cited by examiner

*Primary Examiner* — Timothy L Maust
(74) *Attorney, Agent, or Firm* — Knobbe Martens Olson & Bear LLP

(57) ABSTRACT

A simple and reliable locking device for a quick-action connection coupling for transferring gaseous and/or liquid fluids, especially for refuelling vehicles, is provided. Said device comprises a hand lever (50) for actuating a valve and a lock which is positioned on the end side thereof and engages with a hand grip (45) in the refuelling position. To this end, an unlocking lever (46) which can be pivoted on the hand grip (45) is mounted adjacent to the end region of the hand lever (50). The unlocking lever (46) comprises at least one, preferably two laterally protruding journals (47), arranged inside the hand grip (45), especially for simple handling.

5 Claims, 2 Drawing Sheets

LOCKING DEVICE FOR A QUICK-ACTION CONNECTION COUPLING

The invention relates to a locking device for a quick-action connection coupling according to the features in the preamble of claim 1.

The aim of such quick-action connection couplings (e.g. in accordance with DE 33 13 258) is to provide a secure and rapid connecting capability for refueling vehicles. Especially important is the ability to operate the quick-action connection coupling in a simple and smooth manner, so that even in the case of adverse conditions or persons with less technical aptitude are offered easy handling of the same. For locking a hand lever which is used for this purpose, a latching mechanism is shown in the above specification which can be unlocked only with a relatively high amount of force.

WO 98/04866 of the applicant further shows a quick-action connection coupling where several valves are provided in order to ensure secure connection until the connection is completely established. These valves are switched after the application of the quick-action connection coupling in a certain predetermined sequence, with the outlet valve being opened first, the tongs being closed in the case of further movement of a control lever acting as an actuating device, and finally the inlet valve being opened. The amount of force required here is still relatively high, which also applies for locking and unlocking. Although a secure possibility for connection is created hereby, the handling of this coupling still takes getting used to, especially for gas station customers who expect a conventional gas hose nozzle, since in addition to the insertion of the coupling it is necessary to actuate the control lever, so that one-hand operation is hardly possible.

The aim of the invention is therefore to create a locking device for a quick-action connection coupling of the kind mentioned above which in combination with a simple structure allows secure and especially simple and effortless handling.

This object is achieved by a locking device for a quick-action connection coupling for transferring gaseous and/or liquid fluids, especially for refueling vehicles, comprising a hand lever for actuating a valve and a lock which is positioned on the end side thereof and engages with a hand grip in the refueling position, wherein an unlocking lever which can be pivoted on the hand grip is mounted adjacent to the end region of the hand lever. Preferred further developments of the invention are the subject matter of the sub-claims.

The proposed locking device is characterized by especially simple handling which is especially safe in addition. The connection or release of the quick-action connection coupling is carried out with respective unlocking like a gas hose nozzle as known from refueling with petrol especially for refueling a vehicle with natural gas, which is performed with simple manual single-hand operation. This is especially important for reasons of market acceptance of natural gas stations, since the customers hardly need to accept any changes in order to unlock and release the connection coupling after the refueling process. Notice must be taken that the proposed locking apparatus is suitable for various connections or connection nipples. As a result of the unlocking lever which is integrated in the hand grip and which acts upon the similarly arranged locking lever at the end of the hand grip, an effortless and secure unlocking in the manner of one-hand operation is achieved. The hand carrying out the operation hardly needs to be moved or not at all, especially when one or preferably two journals project laterally from the unlocking lever. The unlocking of the locking element is easily possible both for left and right handers. It is relevant for this kind of locking apparatuses that the hand lever of gas hose nozzles is generally known, so that a secure and rapid one-hand operation of the quick-action connection coupling is enabled in a simple way, with the customer of the filling station being principally aware of the actuation sequence.

An embodiment will be explained and described below in closer detail by reference to the enclosed drawings, wherein.

Figure 1:
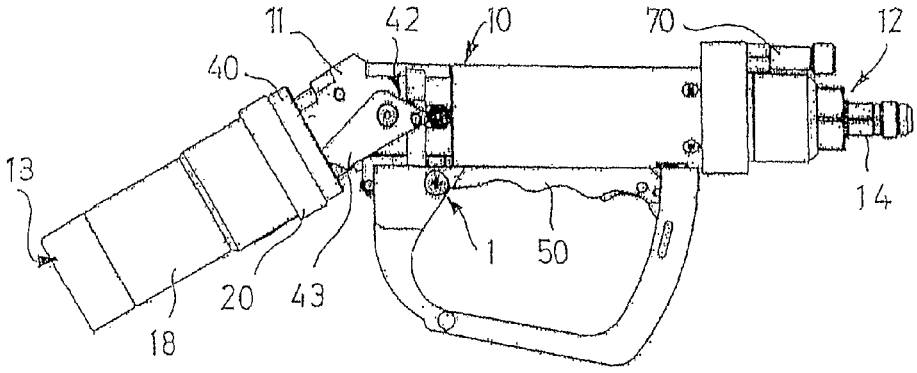
FIG. 1 shows a lateral view of a quick-action connection coupling for a fuel tank connection.
Figure 2:
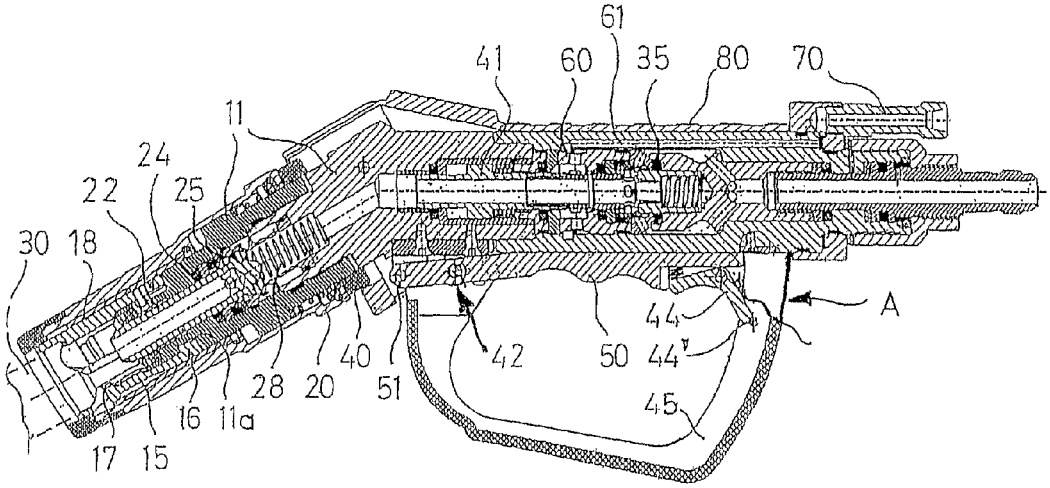
FIG. 2 shows a view of the quick-action connection coupling according to FIG. 1 in a longitudinal sectional view.

FIG. 1 shows an embodiment of a quick-action connection coupling 10 for connection to a connection nipple 30 (see FIG. 2). The quick-action connection coupling 10 comprises a tubular bent housing 11 and mutually connected housing parts, with the right side being used here as an inlet 12 and the left side as an outlet 13 for the further conduction of the fluid to be transferred to the connection nipple 30. The inlet 12 to the housing 11 comprises a connection adapter 14 which can be connected to a hose or pipe for supplying the fluid to be transferred. The connection adapter 14 can be arranged in adjustment to the transferred fluid, especially with respect to the desired feed angle, pass-through cross sections, etc.

On the face side opposite of the connection adapter 14, which is the outlet 13, several elongated tongs 15 which are arranged in tubular form are provided as locking elements (see FIG. 2). The tongs are spread radially to the outside shortly before the insertion onto the connection nipple 30, as is shown in WO-A-93/20378 of the applicant. The elongated tongs 15, which are generally three or six, are hooked into an annular groove 11*a* of the housing 11 which is the right end in this case and is biased by an annular spring 16. At the left end on the bent surface facing to the inside, the tongs 15 comprise engagement profiles 17 which are adjusted to the connection nipples 30.

A sliding sleeve 18 is provided around the tongs 15 which is held on the cylindrical outside jacket of the housing 11 in the manner of a rotary leadthrough and which can be advanced axially with an actuating apparatus 1 in the direction towards the connection nipple 30, as is described below. The sliding sleeve 18 comprises an extension 20 for this purpose which enables the axial displacement of the axial sliding sleeve 18 towards the actuating apparatus 1 in the middle section of the quick-action coupling connection 10, as a result of which the tongs 15 are arrested in the connection position. As is shown in the longitudinal section of FIG. 2, a sealing piston 22 is guided on the inside surface of the housing 11 situated towards the outlet 13. It is sealed with several packing rings 24 inserted at the front end of the housing 11, so that the gaseous and/or liquid fluid flowing along the central axis of the quick-action coupling 10 cannot escape to the outside.

An outlet valve 25 held centrally in the housing 11 is of further relevance. The outlet valve 25 is pressurized in this respect by a pressure spring 28 which is guided in the housing 11. Said outlet valve 25 ensures that shortly before the connection of the quick-action connection 10 to the connection nipple 30 the fluid supplied through the connection adapter 14 cannot be flow out even in the case of an opened connection valve on the refueling system. When the quick-action connection coupling is inserted onto the connection nipple 30, the outlet valve 25 is axially displaced by the sealing piston 22 and the outlet valve 25 is thus opened. An inlet valve 35 of the quick-action connection coupling 10 is still closed however which will be opened only in the further sequence by the actuating apparatus 1 or an associated slide 41, as described below.

A slide ring 40 is further guided on the outside circumference of the housing 11, which slide ring is pressurized by a lever mechanism 42 which also controls the said slide 41. The lever mechanism 42 comprises a hand lever 50 (within a hand grip 45) which after being pulled up or swiveled up about the axis 51 latches into the position shown here with a locking lever 44 at the end of the hand lever 50 on the hand grip 45. An arrest in the form of a locking pin 44' is provided in the interior of the hand grip 45 in order to arrest the hand lever 50 in this locked refueling position. Especially important is an unlocking lever 46 which is arranged in the transitional region A of FIG. 2 and which is shown on an enlarged scale in FIGS. 3 and 4. Said unlocking lever 46 is used for uncoupling by releasing the locking between locking pin 44' and locking lever 44 (cf. FIG. 3), so that the hand lever 50 can then move downwardly about its axis 51 (clockwise here), with the coupled components of the lever mechanism 42 and the protruding valves thus following the same.

Figure 3:
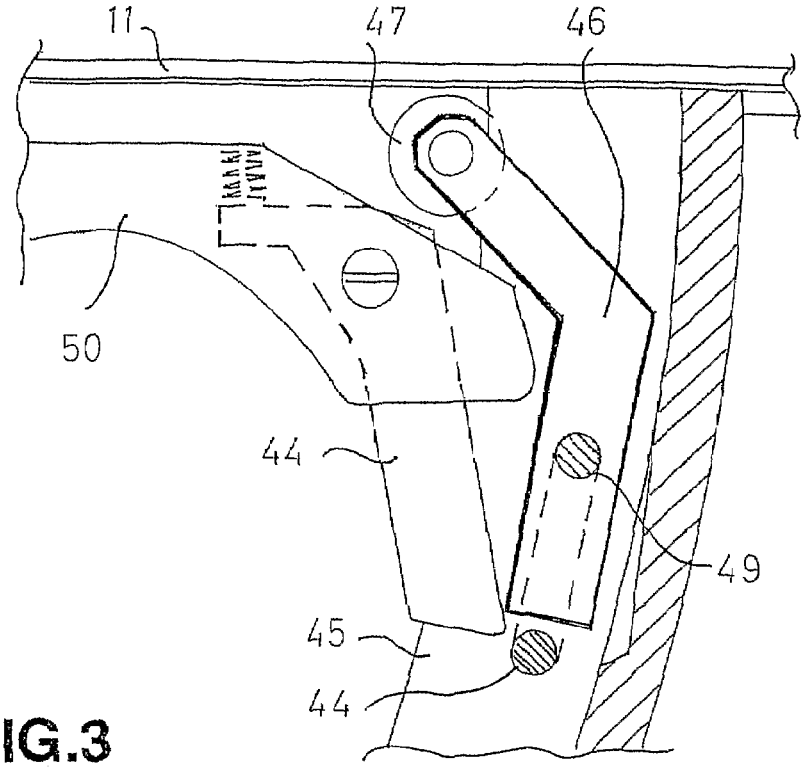
FIG. 3 shows an enlarged representation of the transitional section A in FIG. 2.

FIG. 3 shows the end section of the hand lever 50 on an enlarged scale, on which the locking lever 44 is arranged in a swivelable manner and locks into the locking pin 44' when pulled up under the pressure of a spring. The angular unlocking lever 46 is held in the hand grip 45 in accordance with the novelty of the invention, namely on the upper leg of a clamp 49 (cf. FIG. 4). Two journals 47 are provided at the upper end of the unlocking lever 46, on which the unlocking lever 46 can be swiveled in the clockwise direction (by grasping with two fingers or by pressing with a finger/thumb). As a result, the previously locked locking lever 44 is pressed from its locked position on the locking pin 44' which is preferably formed by the lower leg of clamp 49. As a result, the hand lever 50 can be swiveled downwardly within the hand grip 45 in order to finally remove the coupling 10.

Figure 4:
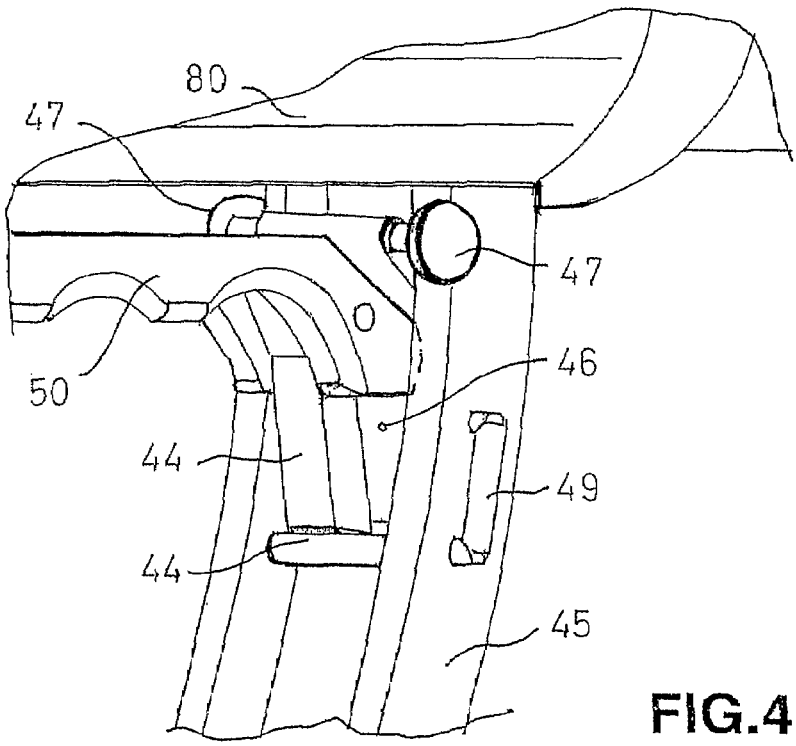
FIG. 4 shows a perspective view according to FIG. 3.

As is shown three-dimensionally in FIG. 4, the unlocking lever 46 is held by means of journals 47 in the hand grip 45 in a ready-to-grip and well-protected manner and integrated therein in a compact way. Said clamp 49 offers a double benefit, which on the one hand is the bearing of the unlocking lever 46 and on the other hand the formation of the locking pin 44', into which the locking lever 44 latches when the hand lever is pulled up and thus locks the lever mechanism. The journals 47 which protrude slightly to the side are arranged in a well-protected manner in the transitional area from the hand grip 45 to the handle or its casing 80, but are still easy to reach by the fingers on the casing 80, so that the unlocking lever 46 can be swiveled in the manner of a one-hand actuation in order to release the lock 44/44' at the end of the refueling process.

As is mentioned above in connection with FIG. 2, the slide 41 is not only provided for the controlled opening of the inlet valve 35, but also for actuating an interposed vent valve 60. It leads via a bore 61 arranged in housing 11 (see FIG. 2) to a vent connection 70, so that any gas remaining in the connection coupling 10 can be recirculated. Said vent valve 60 which is co-actuated by the slide 41 also facilitates uncoupling because a defined pressure degradation can thus be achieved.

With respect to the shape of the unlocking lever 46, the same can also be bent or extended in a straight line instead of being angular or cranked insofar as these dimensions of the unlocking lever 46 allows achieving the leverage of the manual force (on pins 47) which is relevant here in order to bring the locking lever 44 from the locking engagement with the lowest possible application of force. Wedge surfaces or ramps can be advantageous in order to achieve a high amount of leverage.

Said leverage is also influenced by the lengths of the lever on the unlocking lever 46 (distance between fulcrum and point of application) in order to release the locking lever 44 at the end of hand lever 50 with the lowest application of force from the locking engagement for the purpose of releasing the quick-action connection coupling 10 and thus for returning to the connection position. After a short swiveling path, the hand lever 50 is released at first (downwardly), as a result of which the sliding sleeve 18 is retracted. As a result, the tongs 15 can spread radially to the outside again in order to allow the sliding ring 40 to follow axially to the right in this case. Before the sealing contact between the sealing piston 22 and the connection nipple 30 is released, the outlet valve 25 is closed in the manner of a sequence control. As a result of this virtually simultaneous sequence, a very rapid closure of the inlet and outlet valves 35 and 25 is achieved, so that no fluid volume can escape. The unlocking lever 46 in combination with its lever transmission thus allows an effortless, simple uncoupling of the quick-action connection coupling 10 in one-hand operation.

The invention claimed is:

1. A locking device for a quick-action connection coupling for transferring gaseous and/or liquid fluids, especially for refueling vehicles, comprising a hand lever for actuating a valve and a lock which is positioned on the end side thereof and engages with a hand grip in the refueling position, wherein the lock on the hand lever on the end side comprises a locking lever which can be latched into a locking pin of the hand grip, wherein an unlocking lever which can be pivoted on the hand grip is mounted adjacent to the end region of the hand lever, wherein the unlocking lever is held in a swivelable manner on a first leg of a clamp, and wherein a second leg of the clamp forms the locking pin.

2. A locking device according to claim 1, wherein the unlocking lever is arranged as a cranked angle lever.

3. A locking device according to claim 1, wherein the unlocking lever comprises at least one laterally protruding journal arranged inside the hand grip.

4. A locking device according to claim 3, wherein the at least one journal is arranged in a transitional region (A) of the hand grip relative to a casing of the quick-action connection coupling.

5. A locking device according to claim 1, wherein the unlocking lever comprises two laterally protruding journals arranged inside the hand grip.

* * * * *